US006840018B2

(12) United States Patent
Takagi

(10) Patent No.: US 6,840,018 B2
(45) Date of Patent: Jan. 11, 2005

(54) ELONGATE BODIES FOR USE IN PRE-CAST PANEL FORMING SYSTEMS

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 0 days.

(21) Appl. No.: 10/324,220

(22) Filed: Dec. 19, 2002

(65) Prior Publication Data

US 2004/0118070 A1 Jun. 24, 2004

(51) Int. Cl.[7] ..... E04B 5/04

(52) U.S. Cl. ..... 52/600; 52/576; 249/175; 249/185; 249/186

(58) Field of Search ..... 52/576, 600; 264/35, 264/271.1, 274, 279, 279.1; 249/175, 185, 186

(56) References Cited

U.S. PATENT DOCUMENTS 1,632,846 A * 6/1927 Penote ..... 249/186
2,442,962 A * 6/1948 Rumble ..... 249/38
3,754,729 A 8/1973 Maynan
3,872,195 A * 3/1975 Stegmeier ..... 264/35
4,629,155 A * 12/1986 Dula ..... 249/61
D424,215 S 5/2000 Eyring et al.
D428,162 S 7/2000 Eyring et al.
6,279,868 B1 8/2001 Eyring et al.
6,333,461 B1 12/2001 Christophe et al.
6,398,180 B1 6/2002 Eyring et al.

* cited by examiner

*Primary Examiner*—Peter M. Cuomo
*Assistant Examiner*—Stephen Vu
(74) *Attorney, Agent, or Firm*—Dinsmore & Shohl LLP

(57) ABSTRACT

Elongate bodies for use in providing architectural and structural features in pre-cast panels are provided. The elongate bodies may-comprise a cross-section comprising a set portion, a hinged portion, and hinge. The set portion and the hinged portion are configured to define an engagement. The hinge couples the set portion and the hinged portion such that the hinged portion is movable about the hinge to an engaged state and disengaged state. Methods of using the elongate bodies to form pre-cast panels are provided, and pre-cast panel forming systems are provided. It is emphasized that this abstract is provided to comply with the rules requiring an abstract which will allow a searcher or other reader to quickly ascertain the subject matter of the technical disclosure. It is submitted with the understanding that is will not be used to interpret or limit the scope or meaning of the claims. 37 CFR 1.72(*b*).

29 Claims, 3 Drawing Sheets

ELONGATE BODIES FOR USE IN PRE-CAST PANEL FORMING SYSTEMS

BACKGROUND

The present invention relates generally to the formation of pre-cast panels, and more particularly to elongate bodies for providing architectural and structural features in pre-cast panels.

Pre-cast construction of concrete wall panels for tilt-up and other types of construction is well known in the art. In the tilt-up approach, forms, also known as form liners, are placed on a flat casting surface in the shape and dimension of the desired panel and filled with concrete. When the concrete cures, the forms may be removed, and the panel tilted up into a preferred, typically vertical, orientation, where it can be joined to structural frames or other panels. The panels may have architectural features such as reveal bands or structural features formed therein by providing an elongate body that is attached to the casting surface inside the form.

The present inventor has recognized a need for elongate bodies that may be used with a variety of pre-cast systems to provide panels having architectural or structural features. An additional need exists for such bodies that can be easily attached, removed, and reused.

SUMMARY

This need is met by the present invention that provides elongate bodies for use with precast panel forming systems. As used herein, pre-cast panel forming systems include any panel forming system that allows panels to be formed from a cast material that upon curing hardens, thereby allowing the panel to be subsequently placed in a desired location within a building structure.

In accordance with one embodiment, an elongate body comprising a cross-section comprising a set portion, a hinged portion, and a hinge is provided. The set portion comprises a first member defining a base plane, at least a portion of which is configured to engage a panel forming surface. The set portion and the hinged portion are configured to define an engagement. The hinge couples the set portion and the hinged portion such that the hinged portion is movable about the hinge to an engaged state and disengaged state of the engagement, and one of the set portion and the hinged portion define a first beveled edge extending away from the base plane. The elongate body may comprise an extruded member, and the elongate body may comprise a substantially uniform extruded cross-section extending along substantially the entire length of the elongate body. In an engaged state, the first beveled edge may intersect the base plane.

In accordance with another embodiment, the elongate body may also have, in an engaged state, the hinged portion defining a face plane opposite the base plane, the first beveled edge defined by the set portion, the first beveled edge defined by the set portion extending away from the base plane toward the face plane, and the hinged portion further comprising a second beveled edge extending away from the base plane toward the face plane. The first and second beveled edges may comprise inwardly canted edges, and the first and second beveled edges may intersect the base plane. The hinge may be located proximate to the face plane. The hinged portion may further comprise a second member along the face plane between the first and second beveled edges.

In accordance with yet another embodiment, the elongate body may also have, in an engaged state, the set portion further comprising a first sidewall extending away from the first member of the set portion and a second sidewall extending away from the first member of the set portion, the first beveled edge defined by the set portion, the first beveled edge defined by the set portion extending away from the base plane to a portion of the first sidewall of the set portion displaced from the base plane, the hinged portion further comprising a second member extending from a portion of the first sidewall of the set portion displaced from the base plane to a portion of the second sidewall of the set portion displaced from the base plane and a second beveled edge extending away from the base plane to a portion of the second sidewall of the set portion displaced from the base plane.

The hinge may be located proximate to the second member of the hinged portion or adjacent to the first sidewall along the second member of the hinged portion. The engagement may comprise an inwardly extending portion and an outwardly extending portion. The inwardly extending portion may extends from a portion of the second sidewall displaced from the base plane, and the outwardly extending portion of the engagement may extend from the second member such that the inwardly and outwardly extending portions are capable of being engaged. The inwardly extending portion may extend from a portion of the second beveled edge displaced from the base plane, and the outwardly extending portion may extend from the second member such that the inwardly and outwardly extending portions are capable of being engaged.

In accordance with a further embodiment, the elongate body may also have, in an engaged state, the set portion further comprising a first sidewall extending away from the first member of the set portion, the first beveled edge defined by the set portion, and the first beveled edge extending away from the base plane to a portion of the first sidewall of the set portion displaced from the base plane. The hinged portion may further comprise a second member extending away from a portion of the first sidewall of the set portion displaced from the base plane, a second sidewall extending from the second member of the hinged portion to the first member of the set portion, and a second beveled edge extending away from the base plane to a portion of the second sidewall of the hinged portion displaced from said base plane. The hinge may be located proximate to the second member of the hinged portion or adjacent to the first sidewall of the set portion along the second member of the hinged portion.

The engagement may comprise an inwardly extending portion and an outwardly extending portion. The outwardly extending portion may extend from a portion of the second sidewall proximate to the base plane, and the inwardly extending portion may extend from the first member of the set portion such that the inwardly and outwardly extending portions are capable of being engaged. The inwardly extending portion may extend from a portion of the second sidewall proximate to the base plane, and the outwardly extending portion may extend from the first member such that the inwardly and outwardly extending portions are capable of being engaged.

In accordance with another embodiment, the elongate body may also have, in an engaged state, the hinged portion further comprising a first sidewall extending away from the first member, the first beveled edge defined by the hinged portion, and the first beveled edge extending from the first member to a portion of the first sidewall displaced from the base plane. The hinge may be located proximate to said first member of said set portion.

The engagement may comprise an inwardly extending portion and an outwardly extending portion, and the hinge may be located proximate to the first member along the first sidewall. The inwardly extending portion may extend from a portion of the first beveled edge proximate to the base plane, and the outwardly extending portion may extend from the first member such that the inwardly and outwardly extending portions are capable of being engaged.

The hinge may be located proximate to the first member along the first beveled edge of the hinged portion, and the engagement may comprise an inwardly extending portion and an outwardly extending portion. The inwardly extending portion may extend from a portion of the first sidewall proximate to the base plane, and the outwardly extending portion may extend from the first member such that the inwardly and outwardly extending portions are capable of being engaged.

In accordance with another embodiment, the elongate body may also have, in an engaged state, the set portion further comprising a first sidewall extending away from the first member, the first beveled edge defined by the hinged portion, and the first beveled edge extending from the first member to a portion of the first sidewall opposite the base plane. The hinge may be located adjacent to the first sidewall of the set portion. The hinge may be located adjacent to a portion of the first sidewall opposite the base plane along the first beveled edge, and the engagement may comprise an inwardly extending portion and an outwardly extending portion. The inwardly extending portion may extend from the first beveled edge proximate to the base plane, and the outwardly extending portion may extend from the first member such that the inwardly and outwardly extending portions are capable of being engaged.

In accordance with another embodiment, a method of manufacturing a pre-cast panel is provided. The method comprises configuring an elongate body comprising a cross-section comprising a set portion, a hinged portion, and a hinge wherein: the set portion comprises a first member defining a base plane, at least a portion of which is configured to engage a panel forming surface; the set portion and the hinged portion are configured to define an engagement; the hinge couples the set portion and the hinged portion such that the hinged portion is movable about the hinge to an engaged state and disengaged state of the engagement; and one of the set portion and the hinged portion define a first beveled edge extending away from the base plane. The method comprises placing the elongate body on the panel forming surface, pouring pre-cast material at least around the elongate body while said pre-cast material is in an uncured state, curing said precast material, removing the elongate body from the panel forming surface. The method may further comprise securing the elongate body to the panel forming surface prior to pouring the pre-cast material. The elongate body may be secured to the panel forming surface with the engagement disengaged, and the engagement may be subsequently engaged.

In accordance with another embodiment, a pre-cast panel forming system is provided. The system comprises at least one pre-cast panel form having a length and at least one elongate body for use with the said at least one pre-cast panel form. The elongate body comprises a cross-section comprising a set portion, a hinged portion, and a hinge. The set portion comprises a first member defining a base plane, at least a portion of which is configured to engage a panel forming surface. The set portion and the hinged portion are configured to define an engagement, and the hinge couples the set portion and the hinged portion such that the hinged portion is movable about the hinge to an engaged state and disengaged state of the engagement. One of the set portion and the hinged portion define a first beveled edge extending away from the base plane, and the elongate body has a length configured to be less than the length of the at least one precast panel form.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1A:
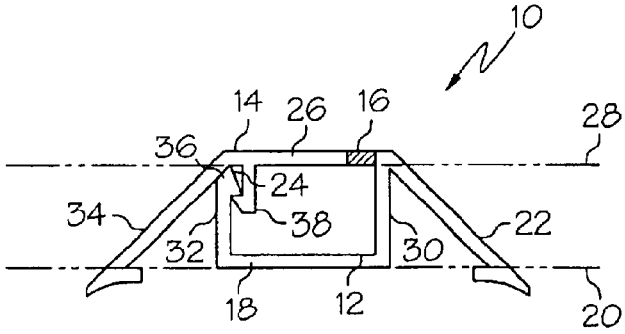
FIGS. 1A–1D are cross-sectional views of elongate bodies in accordance with one aspect of the present invention.

The present invention is directed toward elongate bodies for use with pre-cast panel forming systems. The elongate bodies may be used to provide architectural or structural features in pre-cast panels.

Referring to FIGS. 1A–1D and 2A–2C, several embodiments of an elongate body 10 are illustrated in cross-section in an engaged state. The body 10 has a set portion 12, a hinged portion 14, and a hinge 16. The elongate body 10 of the present invention may be manufactured in an extrusion process and, as such, may comprise an extruded cross-section extending along its entire length. The elongate body may be formed from any plastic material but is preferably formed from extricable plastic materials because the design of the present invention is well-suited for manufacture by an extrusion process. Preferred materials include polyvinyl chloride (PVC), low or high-density polyethylene or polypropylene, acrylics, polycarbonates, and thermoplastic elastomers. As will be appreciated by those familiar with the art of extrusion, an extruded member defines a substantially uniform extruded cross-section that extends along substantially the entire length of the member.

Referring to FIGS. 1A–1D, several embodiments of the elongate body 10 are illustrated. The set portion 12 has a first member 18, and first member 18 defines a base plane 20. At least a portion of the first member 18 is configured to engage a panel forming surface. The hinge 16 couples set portion 12 and hinged portion 14. The set portion 12 and hinged portion 14 are configured to define an engagement 24, and the hinged portion 14 is movable about the hinge 16 to an engaged state and disengaged state of the engagement. The set portion 12 may define a first beveled edge 22 extending away from the base plane 20, and the first beveled edge 22 may intersect the base plane 20.

The hinged portion 14 may define a face plane 28 opposite the base plane 20, and the first beveled edge 22 defined by the set portion may extend away from the base plane 20 toward the face plane 28. The hinged portion 14 may have a second beveled edge 34 extending away from the base plane 20 toward the face plane 28. The first and second beveled edges 22, 34 may be inwardly canted edges as shown in FIGS. 1A–1D, and the first and second beveled edges 22, 34 may intersect the base plane 20.

The hinged portion 14 may have a second member 26 that extends along the face plane 20. The set portion 12 may have a first sidewall 30 extending away from said first member 18. The first beveled edge 22 may extend to a portion of the first sidewall 30 displaced from the base plane 20.

The hinge 16 may be formed in any suitable manner. For example, the hinge 16 may comprise relatively pliant portions of the extruded cross section and the set portion 12 and hinged portion 14 may define relatively rigid portions of the cross section. In this manner, hinge 16 comprises a living hinge formed with the set portion 12 and the hinged portion 14. For the purposes of defining and describing the present invention, it is noted that a living hinge may be bent multiple times without breakage or fracture of the hinge material. Living hinges may be formed from soft, flexible thermoplastic elastomers that exhibit high endurance to flexural fatigue. Although the hinge 16 is shown along the second member 26 adjacent to the first sidewall 30, it will be understood by those having skill in the art at that hinge 16 may be formed in any suitable position that allows the hinged portion 14 to be moved into an engaged and disengaged state of the engagement 24. For example, the hinge 16 may be proximate to the face plane 28.

Figure 1B:
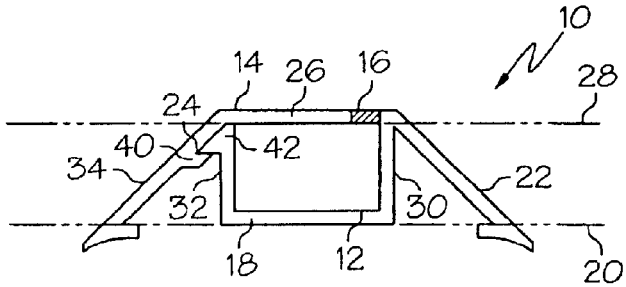

Referring to FIGS. 1A and 1B, the set portion 12 may also have a second sidewall 32 extending away from the first member 18. The second beveled edge 34 may extend to a portion of the second sidewall 32 displaced from the base plane 20. The engagement 24 may have inwardly extending portions and outwardly extending portions, and the inwardly and outwardly extending portions may be formed in a variety of positions. An inwardly extending portion extends generally towards a central axis of elongate body 10, and an outwardly extending portion extends generally away from a central axis of elongate body 10.

For example, as shown in FIG. 1A, the inwardly extending portion 36 of the engagement 24 extends from a portion of the second sidewall 32 of the set portion 12 displaced from the base plane 20, and the inwardly extending portion 36 extends generally towards a central axis of elongate body 10. The outwardly extending portion 38 of the engagement 24 extends from the second member 26 of the hinged portion 14 such that the inwardly extending portion 36 and the outwardly extending portion 38 are capable of being engaged as shown in FIG. 1A. The outwardly extending portion 38 extends generally away from a central axis of elongate body 10. Alternatively, as shown in FIG. **1*b*, the inwardly extending portion 40 of the engagement 24 extends from a portion of the second beveled edge 34 of the hinged portion 14 displaced from the base plane 20. The outwardly extending portion 42 of the engagement 24 extends from the second sidewall 32 at the set portion 12 such that the inwardly extending portion 40 and the outwardly extending portion 42 are capable of being engaged as shown in FIG. 1B**.

Figure 1C:
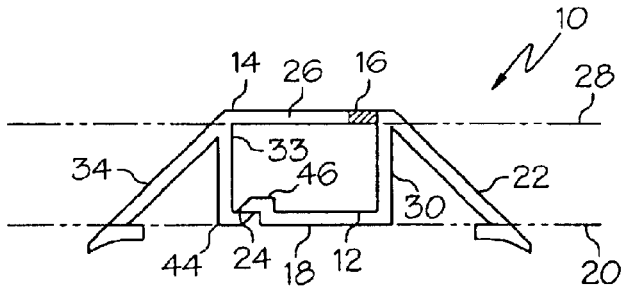
Figure 1D:
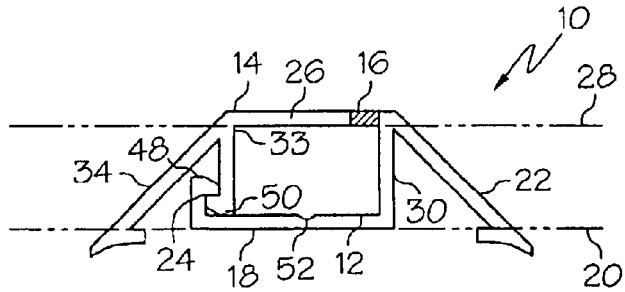

Referring to FIGS. 1C and 1D, the hinged portion 14 may also have a second sidewall 33 extending away from the first member 18. The second beveled edge 34 may extend to a portion of the second sidewall 33 displaced from the base plane 20. The engagement 24 may have an inwardly extending portion and an outwardly extending portion, and inwardly and outwardly extending portion may be formed in a variety of positions.

For example, referring to FIG. 1C, the engagement 24 may have an inwardly extending portion 44 extending from a portion of the second sidewall 33 of the hinged portion 14 proximate to the base plane 20. The engagement 24 may have an outwardly extending portion 46 extending from the first member 18 of the set portion 12 such that the inwardly extending portion 44 and the outwardly extending portion 46 are capable of being engaged as shown in FIG. 1C. Alternatively, referring to FIG. 1D, the engagement 24 may have an outwardly extending portion 50 extending from a portion of the second sidewall 33 of the hinged portion 14 proximate to the base plane 20. The engagement 24 may have an inwardly extending portion 48 extending from the first member 18 of the set portion 12 such that the inwardly extending portion 48 and outwardly extending portion 50 are capable of being engaged as shown in FIG. 1D.

Referring again to FIG. 1D, the elongate body 10 may have a fastening area or areas 52 provided in the first member 18. For example, the fastening areas 52 may be grooves formed in the first member 18 in order to allow fasteners such as nails or screws (not shown) to be more easily driven through the first member 18 to secure the elongate body 10 to a panel forming area. It will be understood by those having skill in the art that the fastening areas may be provided in the first member 18 and **18*a* of the elongate bodies shown in FIGS. 1A–1D and 2A–2C**.

Figure 3:
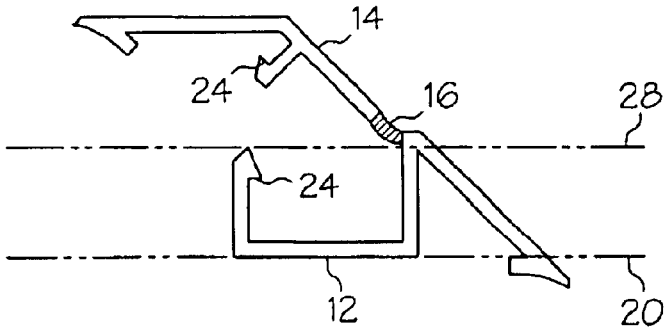
FIG. 3 is a cross-sectional view of an elongate body in a disengaged state in accordance with the present invention.

Referring to FIG. 3, the elongate body 10 illustrated in FIG. 1A is shown with the engagement 24 in a disengaged state. Thus, the hinged portion 14 is movable about the hinge 16 to an engaged state and disengaged state of the engagement 24. When the engagement 24 is in a disengaged state, the first member 18 may be exposed in order to allow the first member 18 to be fastened to a panel forming surface. Subsequently, the engagement 24 may be engaged in order to allow the elongate body 10 to be used to form architectural features in pre-cast panels. It will be understood that the elongate bodies illustrated in FIGS. 1B–1D may be similarly engaged and disengaged about the engagement 24.

Figure 2A:
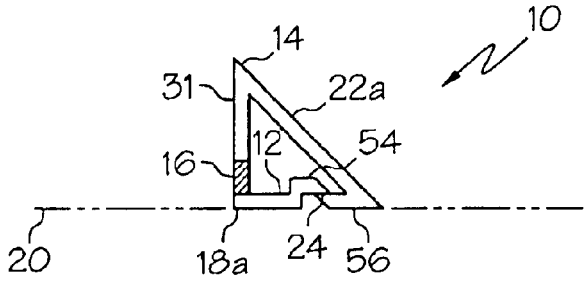
FIGS. 2A–2C are cross-sectional views of elongate bodies in accordance with another aspect of the present invention.
Figure 2B:
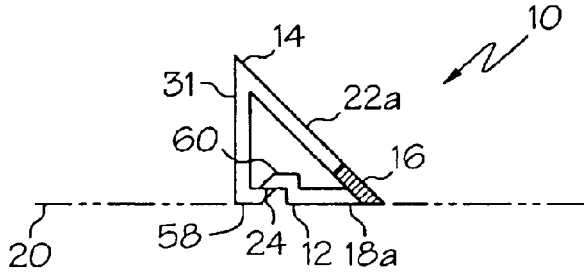
Figure 2C:
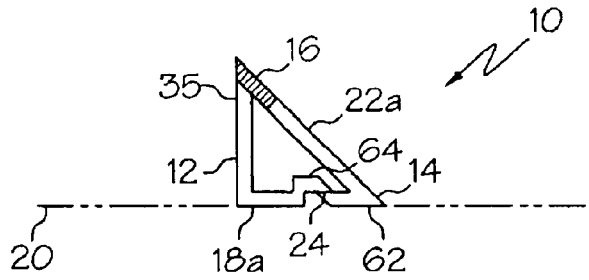

Referring to FIGS. 2A–2C, alternative embodiments of the elongate body 10 are illustrated. The set portion 12 has a first member **18*a*, and the first member 18*a* defines a base plane 20. At least a portion of the first member 18*a* is configured to engage a panel forming surface. The hinge 16 couples the set portion 12 and the hinged portion 14. The set portion 12 and the hinged portion 14 are configured to define an engagement 24, and the hinged portion 14 is movable about the hinge 16 to an engaged and disengaged state of the engagement 24 as described above in conjunction with the embodiments illustrated in FIGS. 1A–1D. The hinged portion 14 may define a first beveled edge 22*a* that extends away from the base plane 20**.

Referring to FIGS. 2A–2B, the hinged portion 14 may further define a first sidewall 31 extending away from the first member **18*a*. The first beveled edge 22*a* may extend from the first member 18*a* of the set portion 12 to a portion of first sidewall 31 of the hinged portion 14 displaced from the base plane 20. The hinge 16 may be located proximate to the first member 18*a* of the set portion 12. For example, as shown in FIG. 2A, the hinge 16 may be located proximate to the first member 18*a* of the set portion 12 along the first sidewall 31 of the hinged portion 14. Alternatively, as shown in FIG. 2B, the hinge 16 may be located proximate to the first member 18*a* of the set portion 12 along the first beveled edge 22***a* of the hinged portion 14. It will be understood by those having skill in the art that the exact location of the hinge may be changed so long as the engagement 24 may be engaged and disengaged effectively.

The engagement 24 may have an inwardly extending portion and an outwardly extending portion, and inwardly and outwardly extending portion may be formed in a variety of positions. For example, as shown in FIG. 2A, the engagement 24 may have an inwardly extending portion 56 extending from a portion of the first beveled edge 22*a* of the hinged portion 14 proximate to the base plane 20. The engagement 24 may have an outwardly extending portion 54 extending from the first member 18*a* of the set portion 12 such that the inwardly extending portion 56 and the outwardly extending portion 54 are capable of being engaged as shown in FIG. 2A. Alternatively, as shown in FIG. 2B, the engagement 24 may have inwardly extending portion 58 extending from a portion of the first sidewall 31 of the hinged portion 14 proximate to the base plane 20. The engagement 24 may have an outwardly extending portion 60 extending from the first member 18*a* of the set portion 12 such that the inwardly extending portion 58 and the outwardly extending portion 60 are capable of being engaged as shown in FIG. 2B.

Referring to FIG. 2C, the set portion 12 may further define a first sidewall 35 extending away from the first member 18*a*. The first beveled edge 22*a* may extend from the first member 18*a* of the set portion 12 to a portion of first sidewall 35 of the set portion 12 displaced from the base plane 20. The hinge 16 may be located proximate to the first sidewall 35 of the set portion 12. The engagement 24 may have an inwardly extending portion and an outwardly extending portion, and inwardly and outwardly extending portion may be formed in a variety of positions. For example, the engagement 24 may have an inwardly extending portion 62 extending from the first beveled edge 22*a* of the hinged portion 14 proximate to the base plane 20. The engagement may have an outwardly extending portion 64 extending from the first member 18*a* of the set portion 12 such that the inwardly extending portion 62 and outwardly extending portion 64 are capable of being engaged as shown in FIG. 2C.

Figure 4:
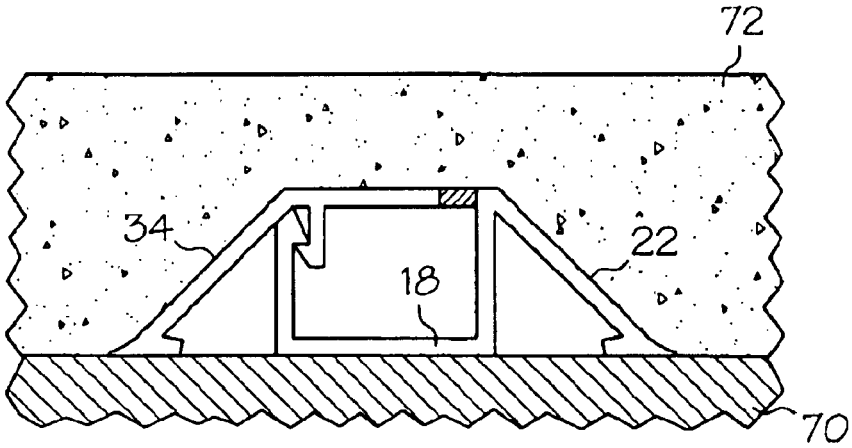
FIG. 4 is a cross-sectional view of an elongate body in a casting operation in accordance with the present invention.

FIG. 4 illustrates an elongate body 10 similar to the embodiments illustrated in FIGS. 1*a*–1*b* in a concrete casting operation. The elongate body 10 is secured to the panel forming surface 70. The elongate body 10 may be secured to the panel forming surface 70 through conventional means, such as tape, screws, nails, rivets or a soluble glue (not shown). At least a portion of the first member 18 engages the panel forming surface 70. For example, the elongate body 10 may be opened about the hinge 16 to a disengaged state (not shown) and nailed to the panel forming surface. The engagement 24 is subsequently engaged, and the pre-cast material is poured around at least the elongate body 10 in an uncured state and allowed to cure. Although FIG. 4 illustrates an elongate body similar those in FIGS. 1A–1D, it will be understood by those having skill in the art that the elongate bodies 10 of FIGS. 2A–2C may be similarly utilized.

Referring to FIGS. 1A–1D and 4, the intersection of the beveled edges 22, 34 with the base plane 20 ensures that a generally downward-projecting load provided by the casting material 72 will force the beveled edges 22, 34 to laterally scrape along the panel-forming surface 70, thus minimizing the amount of pre-cast material 72, such as concrete, that can seep in underneath elongate body 10. This seal between the beveled edges 22, 34 and the panel forming surface 70 promotes long-life, reusable elongate bodies, as the opportunity for the formation of cured/hardened casting material on the elongate body surfaces is reduced.

A method of manufacturing pre-cast panels would include configuring an elongate body as described in conjunction with the embodiments herein, placing the elongate body on a panel forming surface, securing the elongate body to the surface through conventional means, such as tape, screws, nails, rivets or a soluble glue, pouring pre-cast material into a panel at least partially defined by the elongate body, curing the poured concrete, and removing the elongate body from the panel forming surface. The elongate body may be secured with the engagement disengaged and the engagement may be subsequently engaged.

Figure 5:
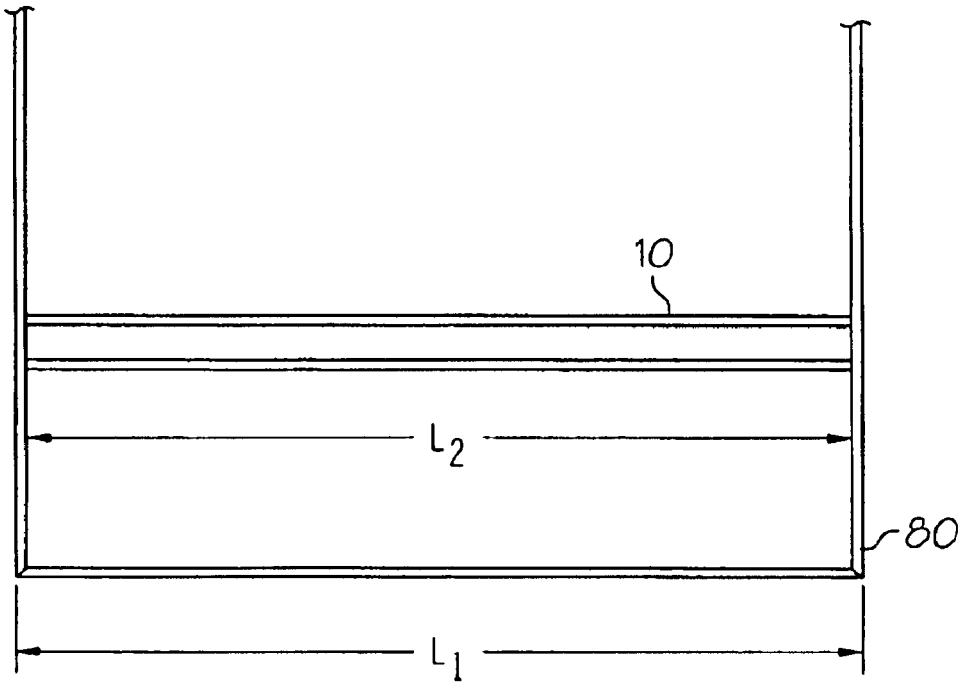
FIG. 5 is a partial top view of a pre-cast panel forming system in accordance with the present invention.

Referring to FIG. 5, a portion of a pre-cast panel form 80 having an elongate body 10 placed therein is illustrated. The pre-cast panel form 80 has a length $L_1$. Elongate body 10 is configured to have a length $L_2$ that is less than the length $L_1$ of the pre-cast panel form 80. Thus, the pre-cast panel form 80 and at least one elongate body 10 may form a system for forming pre-cast panels having architectural or structural features to be utilized as described above. It will be understood by those having skill in the art that more than one elongate body 10 may be utilized and that the elongate bodies 10 may be of different lengths. Additionally, the elongate bodies 10 may be configured in any desired configuration.

It will be obvious to those skilled in the art that various changes may be made without departing from the scope of the invention, which is not to be considered limited to what is described in the specification.

What is claimed is:

1. An elongate body for forming features in a pre-cast panel, said body comprising a cross-section, said cross-section comprising a set portion, a hinged portion, and a hinge wherein:

said set portion comprises a first member defining a base plane, at least a portion of which is configured to engage a panel forming surface;

said set portion and said hinged portion are configured to define an engagement;

said hinge couples said set portion and said hinged portion such that said hinged portion is movable about said hinge between an engaged state and a disengaged state of said engagement; and at least one of said set portion and said binged portion define a beveled edge extending away from said base plane and said first beveled edge is configured to define at least a portion of said features in said pre-cast panel and to be subject to a generally downward-projecting load provided by casting material forming said pre-cast panel.

2. The elongate body as claimed in claim 1, wherein said elongate body comprises an extruded member.

3. The elongate body as claimed in claim 1, wherein said elongate body comprises a substantially uniform extruded cross-section extending along substantially the entire length of said elongate body.

4. The elongate body as claimed in claim 1, wherein, in an engaged state, said beveled edge intersects said base plane.

5. The elongate body as claimed in claim 1, wherein said firs member defines at least one fastening area therein.

6. The elongate body as claimed in claim 1, wherein, in an engaged state:

said hinged portion defines a face plane opposite said base plane;

said beveled edge is defined by said set portion;

said beveled edge defined by said set portion extends away from said base plane toward said face plane; and said hinged portion further comprises a second beveled edge extending away from said base plane toward said face plane.

7. The elongate body as claimed in claim 6, wherein, in an engaged state, said first and second beveled edges comprise inwardly canted edges.

8. The elongate body as claimed if claim 6, wherein, in an engaged state, said first and second beveled edges intersect said base plane.

9. The elongate body as claimed in claim 6, wherein, in an engaged state, said hinge is located proximate to said face plane.

10. The elongate body as claimed in claim 6, wherein, in an engaged state, said hinged portion further comprise a second member along said face plane between said first and second beveled edges.

11. The elongate body as claimed in claim 10, wherein, in an engaged state:

said beveled edge extends inwardly away from said base plane to said second member; and said second beveled edge extends inwardly away from said base plane to said second member.

12. The elongate body as claimed in claim 1, wherein, in an engaged state:

said set portion further comprises a first sidewall extending away from said first member of said set portion and a second sidewall extending away from said first member of said set portion;

said beveled edge is defined by said set portion;

said beveled edge defined by said set portion extends away from said base plane to a portion of said first sidewall of said set portion displaced from said base plane; and said hinged portion further comprises a second member extending from a portion of said first sidewall of said set portion displaced from said base plane to a portion of said second sidewall of said set potion displaced from said base plane, and a second beveled edge extending away from said base plane to a portion of said second sidewall of said set portion displaced from said base plane.

13. The elongate body as claimed in claim 12, wherein said hinge is located proximate to said second member of said hinged portion.

14. The elongate body as claimed in claim 12, wherein said hinge is located adjacent to said first sidewall along said second member of said hinged portion.

15. The elongate body as claimed in claim 12, wherein, in an engaged state:

said engagement comprises an inwardly extending portion and an outwardly extending portion;

said inwardly extending portion of said engagement extends from a portion of said second sidewall of said set portion displaced from said base plane; and said outwardly extending potion of said engagement extends from said second member of said hinged portion such that said inwardly and outwardly extending portions am capable of being engaged.

16. The elongate body as claimed in claim 12, wherein, in an engaged state: said engagement comprises an inwardly extending portion and an outwardly extending portion;

said inwardly extending portion of said engagement extends from a portion of said second beveled edge of said hinged portion displaced from said base plane; and said outwardly extending portion of said engagement extends from said second sidewall of said set portion such that said inwardly and outwardly extending portions are capable of being engaged.

17. The elongate body as claimed in claim 1, wherein, in an engaged state:

said set portion further comprises a first sidewall extending away from said first member of said set portion;

said beveled edge is defined by said set portion;

said beveled edge extends away from said base plane to a portion of said first sidewall of said set portion displaced from said base plane; and said hinged portion further comprises a second member extending away from a portion of said first sidewall of said set portion displaced from said base plane, a second sidewall extending from said second member of said hinged portion to said first member of said set portion, and a second beveled edge extending away from said base plane to a portion of said second sidewall of said hinged portion displaced from said base plane.

18. The elongate body as claimed in claim 17, wherein said hinge is located proximate to said second member of said hinged portion.

19. The elongate body as claimed in claim 17, wherein said hinge is located adjacent to said first sidewall of said set portion along said second member of said hinged portion.

20. The elongate body as claimed in claim 17, wherein, in an engaged state:

said engagement comprises an inwardly extending portion and an outwardly extending portion;

said outwardly extending portion of said engagement extends from a portion of said second sidewall of said hinged portion proximate to said base plane; and said inwardly extending portion of said engagement extends from said first member of said set portion such that said inwardly and outwardly extending portions are capable of being engaged.

21. The elongate body as claimed in claim 17, wherein, in an engaged state:

said engagement comprises an inwardly extending portion and an outwardly extending portion;

said inwardly extending portion of said engagement extends from a portion of said second sidewall of said hinged portion proximate to said base plane; and said outwardly extending portion of said engagement extends from said first member of said set portion such that said inwardly and outwardly extending portions are capable of being engaged.

22. The elongate body as claimed in claim 1, wherein, in an engaged state:

said hinged portion further comprises a first sidewall extending away from said first member;

said beveled edge is defined by said hinged portion; and said beveled edge extends from said first member of said set portion to a portion of said first sidewall of said hinged portion displaced from said base plane.

23. The elongate body as claimed in claim 22, wherein said hinge is located proximate to said first member of said set portion.

24. The elongate body as claimed in claim 22, wherein, in an engaged state:

said hinge is located proximate to said first member of said set portion along said first sidewall of said hinged portion;

said engagement comprises an inwardly extending portion and an outwardly extending portion;

said inwardly extending portion of said engagement extends from a portion of said beveled edge of said hinged portion proximate to said base plane; and said outwardly extending portion of said engagement extends from said first member of said set portion such that said inwardly mad outwardly extending portions are capable of being engaged.

25. The elongate body as claimed in claim 22, wherein, in an engaged state:

said hinge is located proximate to said first member of said set portion along said beveled edge of said hinged portion;

said engagement comprises an inwardly extending portion and an outwardly extending portion;

said inwardly extending portion of said engagement extends from a portion of said first sidewall of said hinged portion proximate to said base plane; and said outwardly extending portion of said engagement extends from said first member of said set portion such that said inwardly and outwardly extending portions are capable of being engaged.

26. The elongate body as claimed in claim 1, wherein, in an engaged state:

said set portion further comprises a first sidewall extending away from said first member;

said beveled edge is defined by said hinged portion; and said beveled edge extends from said first member to a portion of said first sidewall opposite said base plane.

27. The elongate body as claimed in claim 26, wherein said hinge is located adjacent to said first sidewall of said set portion.

28. A pre-cast panel forming system, comprising:

at least one precast panel form having a length; and at least one elongate body for use with said at least one pre-cast panel form; said at least one elongate body comprising a cross-section comprising a set portion, a hinged portion, and a hinge wherein:

said set portion comprises a first member defining a base plane, at least a portion of which is configured to engage a panel forming surface;

said set portion and said hinged portion are configured to define an engagement;

said hinge couples said set portion and said hinged portion such that said hinged portion is movable about said hinge between an engaged state and a disengaged state of said engagement;

at least one of said set portion and said hinged portion define a beveled edge extending away from said base plane; and said elongate body has a length configured to be less than the length of said at least one pre-cast panel form.

29. An elongate body comprising a cross-section, comprising a set portion, a hinged portion, and a hinge wherein:

said hinged is formed from a material exhibiting a greater degree of flexibility than a material forming a remaining portion of said body;

said set portion comprises a first member defining a base plane, at least a portion of which is configured to engage a panel forming surface;

said set portion and said hinged portion are configured to define an engagement;

said hinge couples said set portion and said hinged portion such that said hinged portion is movable about said hinge between an engaged state and a disengaged state of said engagement; and at least on of said set portion and said hinged portion define a beveled edge extending away from said base plane.

* * * * *

UNITED STATES PATENT AND TRADEMARK OFFICE

CERTIFICATE OF CORRECTION

PATENT NO. : 6,840,018 B2
DATED : January 11, 2005
INVENTOR(S) : Takagi

It is certified that error appears in the above-identified patent and that said Letters Patent is hereby corrected as shown below:

Column 8,
Line 44, “set portion and said binged portion” should read -- set portion and said hinged portion --
Line 69, “firs member defines” should read -- first member defines --

Column 9,
Line 7, “body as claimed if claim 6,” should read -- body as claimed in claim 6, --
Line 59, “extending portions am capable” should read -- extending portions are capable --

Column 11,
Line 6, “that said inwardly mad outwardly” should read -- that said inwardly and outwardly --

Column 12,
Line 33, “at least on of said” should read -- at least one of said --

Signed and Sealed this

Twelfth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,840,018 B2
DATED : January 11, 2005
INVENTOR(S) : Takagi

It is certified that error appears in the above-identified patent and that said Letters Patent is hereby corrected as shown below:

Title page,
Item [57], ABSTRACT, "Elongate bodies for use in providing architectural and structural features in pre-cast panels are provided. The elongate bodies may-comprise a cross-section comprising a set portion, a hinged portion, and a hinge. The set portion and the hinged portion are configured to define an engagement. The hinge couples the set portion and the hinged portion such that the hinged portion is movable about the hinge to an engaged state and disengaged state. Methods of using the elongate bodies to form pre-cast panels are provided, and pre-cast panel forming systems are provided. It is emphasized that this abstract is provided to comply with the rules requiring an abstract which will allow a searcher or other reader to quickly ascertain the subject matter of the technical disclosure. It is submitted with the understanding that is will not be used to interpret or limit the scope or meaning of the claims. 37 CFR 1.72 (b).:"
should read -- Elongate bodies for use in providing architectural and structural features in pre-cast panels are provided. The elongate bodies may comprise a cross-section comprising a set portion, a hinged portion, and a hinge. The set portion and the hinged portion are configured to define an engagement. The hinge couples the set portion and the hinged portion such that the hinged portion is movable about the hinge to an engaged state and disengaged state. Methods of using the elongate bodies to form pre-cast panels are provided, and pre-cast panel forming systems are provided. It is emphasized that this abstract is provided to comply with the rules requiring an abstract which will allow a searcher or other reader to quickly ascertain the subject matter of the technical disclosure. It is submitted with the understanding that is will not be used to interpret or limit the scope or meaning of the claims. 37 CFR 1.72(b). --

Column 8,
Line 44, “set portion and said binged portion” should read -- set portion and said hinged portion --
Line 69, “firs member defines” should read -- first member defines --

Column 9,
Line 7, “body as claimed if claim 6,” should read -- body as claimed in claim 6, --
Line 59, “extending portions am capable” should read -- extending portions are capable --

Column 11,
Line 6, “that said inwardly mad outwardly” should read -- that said inwardly and outwardly --

UNITED STATES PATENT AND TRADEMARK OFFICE

CERTIFICATE OF CORRECTION

PATENT NO. : 6,840,018 B2
DATED : January 11, 2005
INVENTOR(S) : Takagi

It is certified that error appears in the above-identified patent and that said Letters Patent is hereby corrected as shown below:

Column 12,
Line 33, "at least on of said" should read -- at least one of said --

This certificate supersedes Certificate of Correction issued April 12, 2005.

Signed and Sealed this

Twenty-eighth Day of June, 2005

JON W. DUDAS
*Director of the United States Patent and Trademark Office*